US006169376B1

(12) United States Patent
Greenberg et al.

(10) Patent No.: US 6,169,376 B1
(45) Date of Patent: Jan. 2, 2001

(54) GAS DISCHARGE TUBE CHANGEABLE COLOR DISPLAY AND DIGITAL CONTROLLER SYSTEM

(75) Inventors: Kenneth Greenberg, Long Island City, NY (US); Alberto Sid, Upper Saddle River, NJ (US)

(73) Assignee: MAF Technologies Corp., Upper Saddle River, NJ (US)

( * ) Notice: Under 35 U.S.C. 154(b), the term of this patent shall be extended for 0 days.

(21) Appl. No.: 09/307,885

(22) Filed: May 10, 1999

(51) Int. Cl.[7] ..... G05F 1/00
(52) U.S. Cl. ..... 315/291; 315/149
(58) Field of Search ..... 315/291, 292, 315/158, 149; 358/240; 313/496

(56) References Cited

U.S. PATENT DOCUMENTS 4,791,336 * 12/1988 Morimoto et al. ..... 313/496
4,922,154 * 5/1990 Cacoub ..... 315/149
5,420,482 * 5/1995 Phares ..... 315/292
5,907,222 * 5/1999 Lengyel et al. ..... 315/158
6,016,038 * 1/2000 Mueller et al. ..... 315/291
6,031,343 * 2/2000 Recknagel et al. ..... 315/292

* cited by examiner

*Primary Examiner*—Don Wong
*Assistant Examiner*—Chuc Tran D
(74) *Attorney, Agent, or Firm*—Notaro & Michalos P.C.

(57) ABSTRACT

A multiple discharge tube lighting system has a plurality of gas discharge tubes positioned behind a translucent panel, within a cove or tube or in close proximity to each other and each tube is connected through a power supply to a dimming control circuit. The control circuit is used to change the brightness and on/off state of each tube to create the appearance of different colors when the tubes are viewed in combination using dimming and/or interleaving. The control circuit can match dimming curves, and stores, retrieves and sends power information for each tube to create displays which can be identically produced repeatedly.

5 Claims, 4 Drawing Sheets

GAS DISCHARGE TUBE CHANGEABLE COLOR DISPLAY AND DIGITAL CONTROLLER SYSTEM

FIELD AND BACKGROUND OF THE INVENTION

The present invention relates generally to the field of lighting for signs and displays and in particular to a new and useful gas discharge tube color display generator having a digital and/or analog programmable control circuit used to regulate power to multiple gas discharge lamps. The system of the invention can be used to create varying gas lighting displays which are quickly and easily changed, stored, recalled and repeated.

Neon signs are widely used to advertise businesses with eye-catching colors and designs. This is especially true in cities like New York City and Las Vegas, Nev.

As used herein, the term "neon sign" refers to several types of excited gas discharge tube displays. While neon is a common inert gas found in the discharge tubes of lighting displays, other inert gases as well as mercury vapor are also used in lighting displays. As used herein, "neon" and "gas discharge tube" are intended to encompass all of the gases and vapors known for use in lighting discharge tubes and tubes using any known gas or vapor, respectively, unless otherwise specified and is not intended to limit the invention to discharge tubes using only neon gas.

Neon lights can be made to produce different colors by changing the physical construction of the discharge tube. To cause a discharge tube to produce a particular color one or more of the following are changed: 1) the gas in the tube; 2) a phosphor coating on the tube; or 3) a filter on the tube. These three factors can be used alone or in combination to produce different colors.

A common type of display sign typically has a discharge tube mounted behind a translucent sheet of material which contains the design or color being illuminated. This type of display is generally static, in that the design of the sign cannot change. The discharge tubes used in this type of sign generally emit white light behind the sheet of material. Neon, fluorescent and incandescent lighting can all be used to illuminate this type of sign.

Another type of neon sign uses discharge tubes to provide an outline of a design. The discharge tubes usually contain a single gas, such as neon, argon, xenon, etc., which emits light in the visible spectrum when excited by electrical energy. Methods used to generate the different colors in the light spectrum in these types of signs are to use different gases in the discharge tubes and to use different phosphorescent coatings on the tubes. The color of the tube is not changeable once the tube has been filled with a single gas or coated with a particular phosphorescent coating. In some cases these signs exhibit movement by switching sections of the discharge tubes on and off, such as between two different arm positions on a display pointing to a business.

In each of these two cases, however, the color of the sign cannot be changed without changing the sign or the discharge tubes.

Changeable lighting displays, such as found on sports stadium scoreboards, use individual single color incandescent lightbulbs which are either lit or darkened to produce a picture when viewed from a distance. Some incandescent bulb displays show messages which are made to appear to move across the display area by rapidly switching the bulbs in sequence.

A luminous tube using noble gases to produce light of different hues is taught by U.S. Pat. No. 4,598,229. The tube has an outer tube and three or more inner tubes mounted inside the outer tube. The three inner tubes each have one cathode electrode, and a common anode electrode is provided in the outer tube. The same inert gas fills each of the three tubes. The inner tubes can each be coated with a different phosphorescent coating to provide a different primary light color when they are illuminated, that is, red, blue and green. From a distance, the tube will appear to be a single color which is the combination of the three colors of the inner tube. The color of light emitted by the tube can be changed by varying the current density to each cathode.

However, a lighting tube of this type is impractical if not impossible to effectively use in a lighting display designed for depicting free flowing shapes or driving tubes of extended length.

None of the known neon lighting systems has a control system which permits rapid changing and storing and recalling of the display and/or complex sequencing using different color combinations created using the control system.

SUMMARY OF THE INVENTION

It is an object of the present invention to provide a multiple set of inert gas discharge tube lighting system having a controller for changing the combined color emitted by the discharge tubes.

It is a further object of the invention to provide a control circuit for a neon gas discharge tube lighting system that can store and recall lighting display sequences and is easily changed to alter the lighting display.

Another object of the invention is to provide a neon lighting system capable of creating combinations of colors and exhibiting complex, variable displays that can be stored, retrieved and repeated.

Accordingly, a multiple discharge tube lighting system has a plurality of gas discharge tubes each connected to a control circuit. The gas discharge tubes are combined in sets of at least two tubes each capable of generating a predetermined color or wavelength light. The tubes in each set are arranged in close proximity to each other, or behind a translucent panel or within a tube or cove, such that from a distance, they appear as a single light. A controller is used to selectively flash or dim each of the discharge tubes to create different colors or effects.

A controller for the lighting system has a micro-controller with a memory for storing and recalling power information settings for each attached power stage control that is input using one of several input devices. The power information is sent from the micro-controller output channels to the power stage controls and then through transformers to the connected discharge tubes. Each discharge tube in a set is connected to a different power stage control.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

One aspect of the invention provides at least two gas discharge tubes in relatively close proximity to each other, behind a translucent panel or within a tube or cove, and connected to a control system to generate different color combinations when the tubes are viewed together.

The discharge tubes are provided with a particular gas, filter and/or coating to cause each tube to emit a particular wavelength of light when excited. For color mixing applications, the discharge tubes used may be grouped in sets of at least two tubes, with each tube emitting a different color (e.g., red, blue and green). The tubes can be positioned behind a translucent material or left exposed. The perceived color emitted by a set of discharge tubes can be varied using the controller to vary the power settings for those tubes, with the same settings being stored digitally, recalled from memory and applied to the power supplies of the discharge tubes for repeating at a later time.

Figure 7:
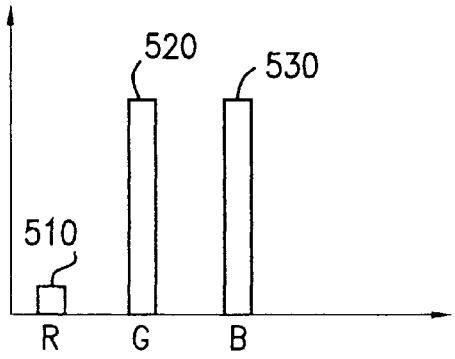
FIG. 7 is a bar graph representation of the relative intensities of three gas discharge tubes used in combination to generate a fourth color.

The control system can be used to selectively dim particular lamps in a set of adjacent tubes, so that when viewed together the lamps produce different colors. FIG. 7 is an example of the light intensity level settings 510, 520, 530 for three gas discharge tubes, each of which emits a different frequency light. In the drawing, a red-emitting tube has a lower intensity level, or is dimmed, relative to the levels for a green-emitting and a blue-emitting tube, which are nearly equal. This combination produces an aqua color when the three lamps are sufficiently close to each other and are viewed from a suitable distance to appear as one light. By adjusting the intensity, or dimming level of each lamp, the effective color produced by the grouping of gas discharge tubes can be changed. The control system is used to dim the tubes by controlling the power provided to each gas discharge tube.

The color combination can also be created by interleaving, wherein the individual tubes are flashed, or turned on and off, at a rate where the human eye (and some types of recording devices) cannot perceive the brief dark periods. A flashing rate of greater than 30 Hz (flashes per second) will generally be imperceptible to the human eye. A control system is used to provide the necessary signals for creating different colors with the discharge tubes.

In interleaving, different tubes emitting different colors, such as red and blue, can be flashed simultaneously or at alternating periods. Referring to the drawings, in which like reference numerals are used to refer to the same or similar elements, FIGS. 1–3 illustrate different timing diagram for three tubes being flashed to produce different colors.

Figure 1:
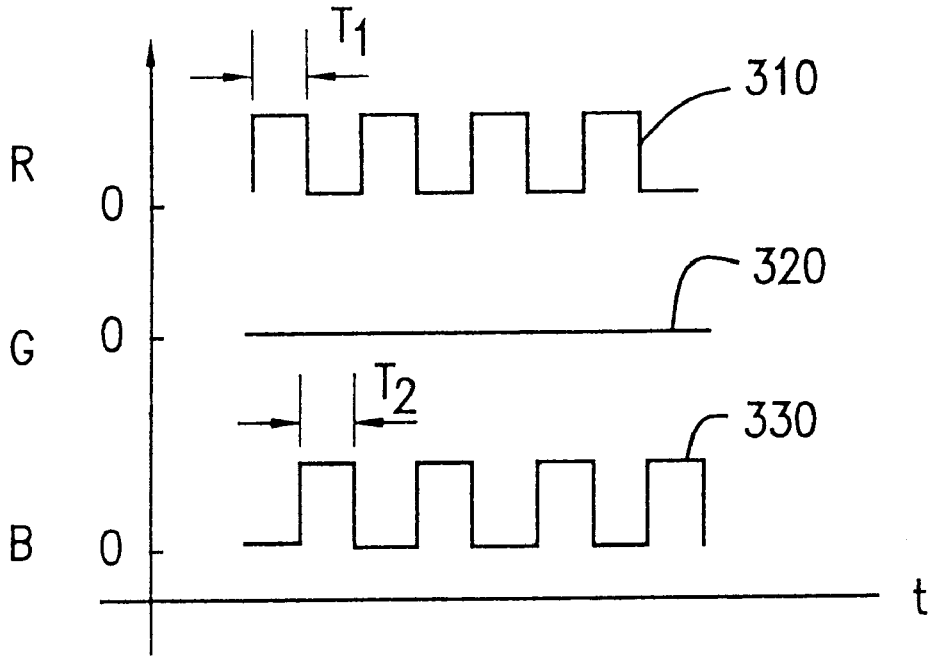
FIG. 1 is a timing diagram showing how the output of multiple discharge tubes can be combined to create different color combinations.

In FIG. 1, a timing diagram for a set of tubes being used to appear to generate a purple light is shown. A tube which generates primarily red light is flashed in a constant pulse signal 310 with equal periods T1 on and off. A second tube which generates primarily blue light is flashed in a second constant pulse signal 330 with equal periods T2 on and off, but with a phase offset from the red pulse signal 310 of 180°. Thus, when the red light is on, the blue light is off and vice-versa. The third tube which generates primarily green light has a zero amplitude signal 320, as it is not used. The periods T1 and T2 are sufficiently small (frequency greater than 30 Hz) that the alternating flashes of red and blue light are combined by the human eye to appear as purple.

Figure 2:
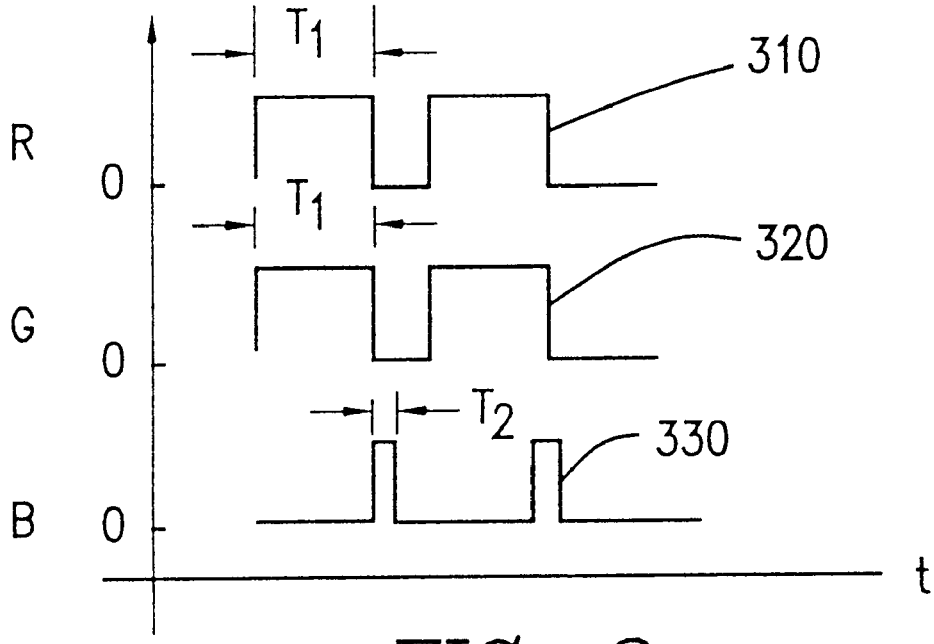
FIG. 2 is a timing diagram like that of FIG. 1 showing a different color combination.

FIG. 2 is an example where the red and green lights have asymmetric pulse signals 310, 320 which are in phase and have the same on period T1, with short off periods. The blue light has an asymmetric pulse signal 330 with a brief on period T2 and a long off period, that is phased with period T2 starting as period T1 ends. This interleave combination appears as a yellow light.

Figure 3:
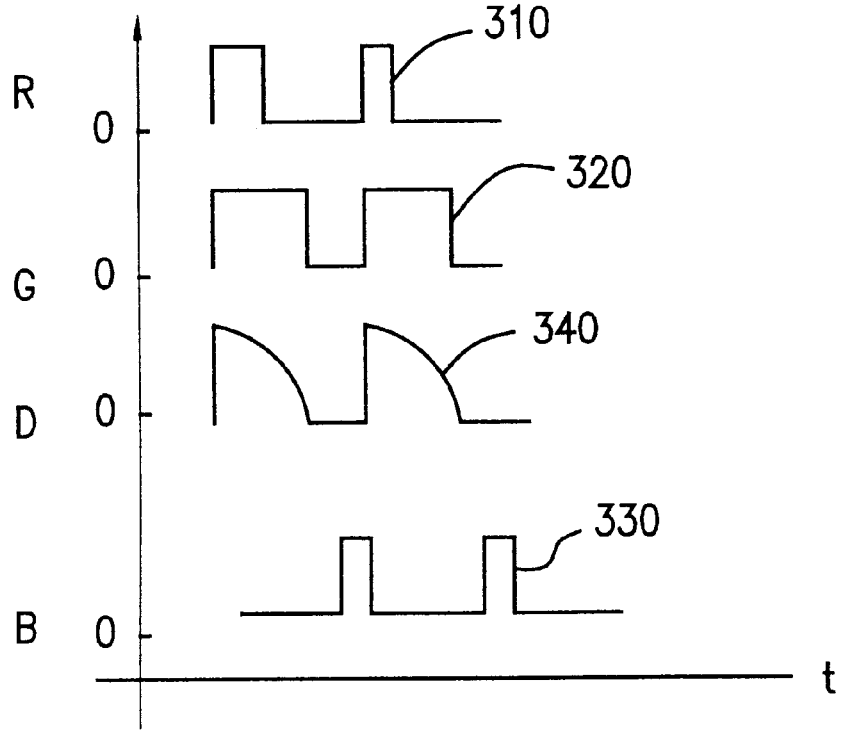
FIG. 3 is a further timing diagram showing yet another color combination.

A green color having a unique appearance is produced using the timing diagram in FIG. 3 in combination with a particular phosphor coating on the green tube. The green tube is flashed at a constant pulse signal 320, which is slightly shorter than the decay rate 340 of the phosphor coating on the tube. The decay rate 340 of the phosphor is the time it takes for the glow generated by activating the tube returns to the non-energized state.

Many different colors can appear to be generated by a combination of only two or three tubes when they are used in this manner. Simply varying the length of time each tube is flashed on provides a method for producing most colors in the visible spectrum. The brightness of each tube can be changed as well to change the color characteristics.

The range of colors and effects available can be further enhanced by selecting different gas or vapor to energize within the tube, different glass (filtered or not) and different phosphors. For example, rare earth phosphor coatings can be used in combination with inert gas and mercury vapor inside the discharge tube.

The pulse signals and tube characteristics can be adjusted to produce a substantially flicker-free light of a desired color. It is also possible to generate light in the ultraviolet and infrared spectrum range to create different effects with the gas discharge tubes.

Figure 4:
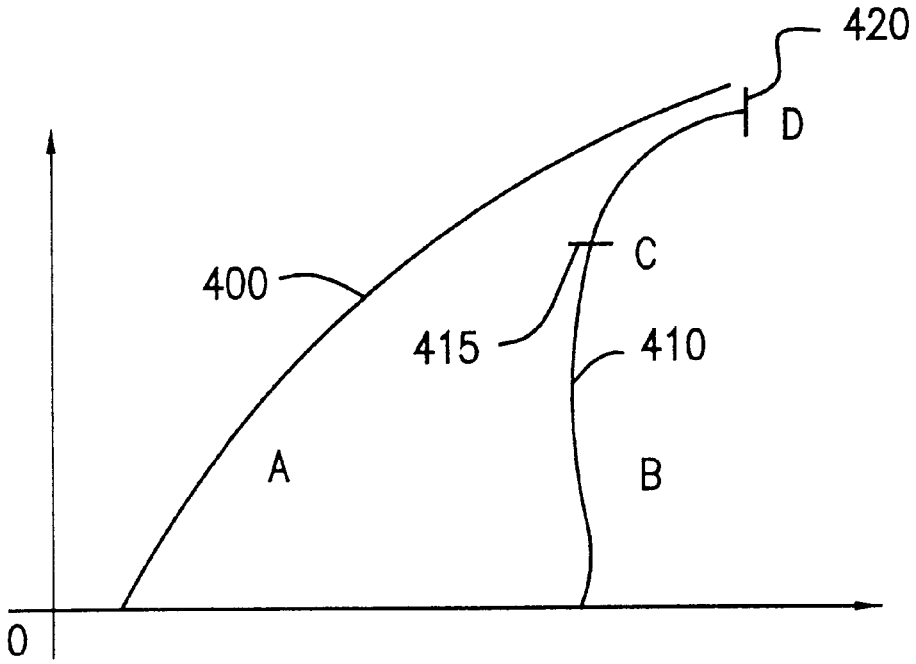
FIG. 4 is a graphical representation of dimming curves for two different discharge tubes.

In a further aspect of the invention, the controller can be used to match the dimming curves of different segments of a light display. The different segments may be individual tubes, or groupings of tubes. As shown in FIG. 4, two different tubes or tube circuits within a neon light display may have radically different dimming curves 400, 410 when considered between zero and maximum power points. While first dimming curve 400 has a smooth, near linear characteristic between zero and maximum power, second dimming curve 410 only exhibits this characteristic in a much smaller region, such as between 75% of maximum power 415 and maximum power 420, and is asymptotic below 75% power 415. The controller according to the invention can be used to modify the power settings for the tubes having second dimming curve 410 so that the range of power settings effected by the master dimmer control for the second set of tubes is only between 75% 415 and maximum power 420.

Figure 5:
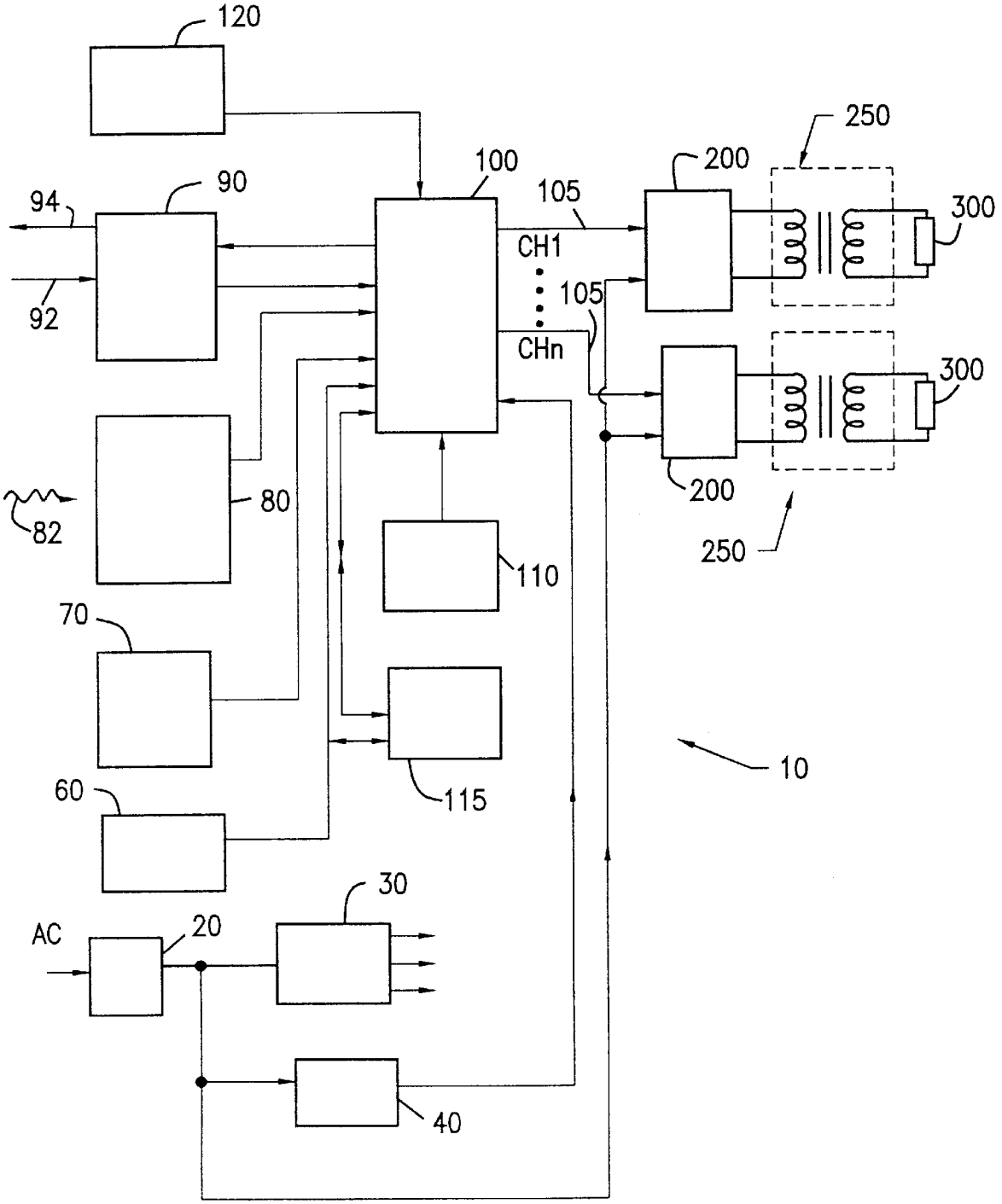
FIG. 5 is a block diagram showing the elements of the control system for a group of discharge tubes.

A control circuit 10 which can be used with the tubes 300 to produce each of the effects discussed above is shown in FIG. 5. A micro-controller 100 is the central feature of the control circuit 10 and is responsible for timing and control of the peripheral hardware connected to it. A computer program can be stored in the micro-controller program memory 110 as firmware for this purpose. The micro-controller 100 has a plurality of output channels 105 which are connected to devices being controlled, such as power stage controls 200. The power stage controls 200 are in turn connected to gas discharge tubes 300 via high voltage transformers 250.

Input information is provided to the micro-controller 100 in one of several ways. A serial protocol interface 90 receives input 92 from a serial link, such as a USITT DMX-512 protocol controller (not shown) and interprets the input 92 for micro-controller 100. The input 92 will generally be the current intensity, or power, levels for each output channel 105 of the micro-controller 100. The serial interface 90 also has output 94 to feed back the information from the micro-controller to a user of the control circuit 10.

The DMX protocol used in a DMX protocol controller is described in a United States Theatre Technology, Inc. (USITT) publication entitled, "DMX512/1990 Digital Data Transmission Standard for Dimmers and Controllers." The protocol is a network protocol having a central controller for creating stream of network data consisting of sequential data packets. Each packet initially contains a header for checking compliance with the standard and synchronizing the beginning of data transmission, which is then discarded. A stream of sequential data bytes representing data for sequentially addressed device follows the header. For example, if the data packet contains information for device number 31, then the first 30 bytes after the header in the data stream will be discarded by device number 31 and byte 31 will be saved and used. When more than one byte of information is needed by a device, then its device number is its starting address and the number of required bytes after the starting address will be saved and used. The DMX-512 protocol uses a data stream of up to 512 bytes each having hexadecimal values corresponding to decimal numbers from 0–255.

Other input devices that could be used with the micro-controller 100 include an RF or IR interface 80 is provided to decode these types of signals 82 carrying the same information as the serial link input. A manual keypad 70 is used to change the intensity information locally at the micro-controller. A mode control block 60 sets the control circuit 10 in a particular control operation mode that determines which input device 70, 80, 90 will be accepted by the micro-controller 100. The control circuit 10 can have all of the input devices 70, 80, 90 or one of them or a combination of two, depending on the application.

Power is provided to all the components in the control circuit 10 and the power stage controls 200 from power supply 30. A zero-cross detector 40 synchronizes the control circuit 10 to the main power line and selects when the micro-controller 100 can switch the power stage controls 200. An EMI filter separates the control circuit 10 from the main power supply and prevents noise pollution on the line.

An over-temperature sensor and control 120 is connected to the micro-controller 100 and can shut the circuit 10 down if the operating temperature exceeds a preset limit.

A non-volatile storage memory 115 is provided to receive and store power information during an operating mode. The power information is pre-set using the inputs 70, 80, 90 and in operating mode used by the micro-controller 100 to control the connected gas discharge tubes 300 through power stage controls 200. The power information is effectively a program which instructs the micro-controller what power, or intensity level to set each channel 105 at while it is operating to produce different colors using gas discharge tubes 300.

Thus, the power information could be a pulse signal on one channel 105 and a steady intensity level on another channel 105, depending on the application and desired display.

When connected, the control circuit 10 can have a plurality of discharge tubes 300 connected to it to be controlled. The tubes 300 may be grouped in sets of two or more to produce different colors depending on the characteristics of the tubes 300 which are in the set. The intensity of each tube 300 is set using one or more of the input devices, and the power information corresponding to the set intensity is stored in memory. The process is repeated as needed to produce a lighting display having changing color or having the appearance of movement, for example.

Figure 6:
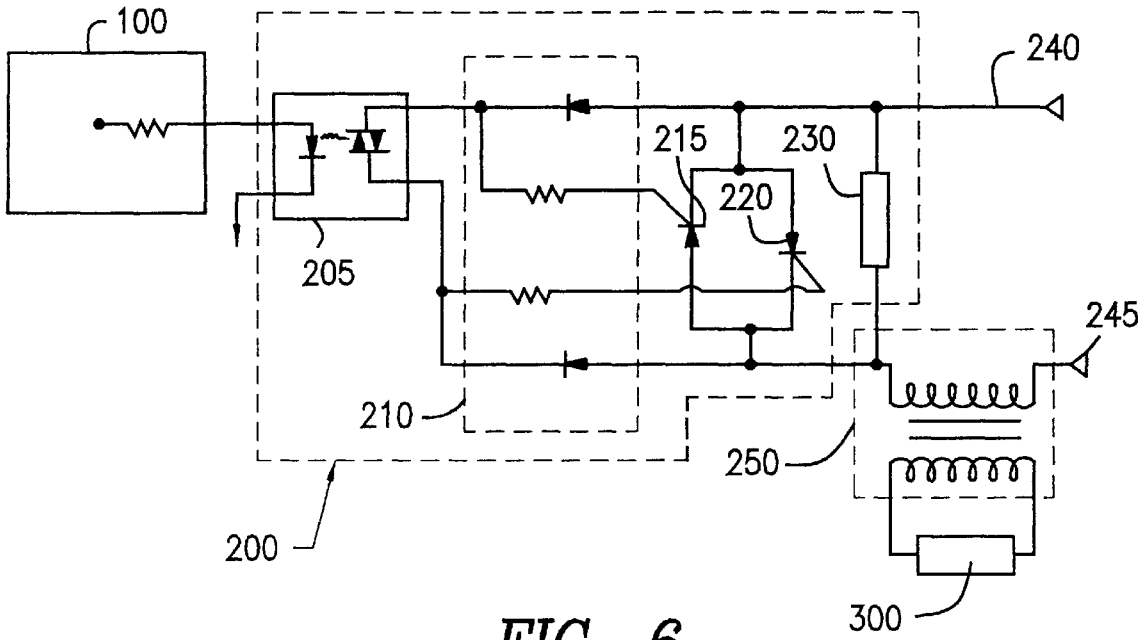
FIG. 6 is a circuit diagram of a power supply used with the control system of FIG. 5.

A known type of power stage control 200 that can be used with the invention is illustrated in the circuit diagram of FIG. 6. An optoisolator 205 is connected to the micro-controller channel 105 output as a high-voltage barrier to separate the discharge tube main voltage from the operating voltage of the power supply 30. The optoisolator 205 also prevents switching noise from feeding back to the micro-controller 100. A current limiting circuit 210 is interposed between back-to-back oriented SCRs 215, 220 to limit the firing gate current from the SCRs 215, 220. The SCRs 215, 220 actually switch the mains 240, 245 into the high voltage transformer 250 load and produce the on/off condition at the connected discharge tubes 300. A snubber circuit 230 is used to prevent backfiring of the SCRs 215, 220 and thereby avoid false triggering of the connected discharge tube 300. Different discharge tube 300 intensities are obtained by changing the firing angle of the SCRs 215, 220. Thus, the power stage control 200 can produce a dimming effect or a flashing effect, which can be used to make a grouping of the discharge tubes 300 have the appearance of many different colors, depending on the settings.

While a specific embodiment of the invention has been shown and described in detail to illustrate the application of the principles of the invention, it will be understood that the invention may be embodied otherwise without departing from such principles.

What is claimed is:

1. A method for producing a color lighting display with gas discharge tubes, the method comprising:

providing at least two gas discharge tubes in close proximity to each other, each tube generating a different color;

providing a number of variable power sources equal to the number of gas discharge tubes;

connecting one variable power source to each gas discharge tube, each tube having its own variable power source; and controlling each variable power source by pulsing at least one of the at least two gas discharge tubes at a frequency of greater than 30 Hz, pulsing a second one of the at least two gas discharge tubes at a second frequency of greater than 30 Hz, the pulsing of each gas discharge tube is out of phase with the other by at least 90° in order to produce the appearance of a wide range of different colors when the at least two gas discharge tubes are viewed from a sufficient distance so as to appear as one light source.

2. A method according to claim 1, further comprising storing a control information in a memory and recalling the control information for controlling each variable power source.

3. A method according to claim 1, wherein the pulsing of each gas discharge tube is at the same frequency.

4. A gas discharge tube lighting system, comprising:

a plurality of gas discharge tubes arranged in sets of at least two tubes in close proximity to each other, each set having color means for generating the appearance of a plurality of different colors;

a plurality of power supplies, each power supply connected to one of the plurality of gas discharge tubes; and a DMX protocol controller for controlling power provided by each of the plurality of power supplies to produce different colors generated by the color means of each set of tubes.

5. A gas discharge tube lighting system according to claim 4, wherein said color means comprises each of the tubes in each set being capable of producing light of a different color.

* * * * *